United States Patent [19]

Phillips

[11] 4,207,853

[45] Jun. 17, 1980

[54] STARTING SYSTEMS FOR INTERNAL COMBUSTION ENGINE

[75] Inventor: Edward G. Phillips, Colne, England

[73] Assignee: Lucas Industries Limited, Birmingham, England

[21] Appl. No.: 926,243

[22] Filed: Jul. 20, 1978

[30] Foreign Application Priority Data

Oct. 19, 1977 [GB] United Kingdom ..... 43468/77

[51] Int. Cl.[2] ..... F02N 17/00

[52] U.S. Cl. ..... 123/179 B; 123/179 BG; 123/179 H

[58] Field of Search ..... 123/179 B, 179 BG, 179 H, 123/148 E, 32 EG

[56] References Cited

U.S. PATENT DOCUMENTS

| | | | |
|---|---|---|---|
| 3,415,999 | 12/1968 | Noury | 123/179 B |
| 3,646,917 | 3/1972 | Nagy | 123/32 EG |
| 3,646,918 | 3/1972 | Nagy et al. | 123/32 EG |
| 3,705,571 | 12/1972 | Horn et al. | 123/32 EG |
| 4,088,109 | 5/1978 | Woodruff et al. | 123/179 BG |
| 4,104,534 | 8/1978 | Hill et al. | 123/179 BG |
| 4,106,465 | 8/1978 | Bernhardt | 123/179 BG |

*Primary Examiner*—Charles J. Myhre
*Assistant Examiner*—P. S. Lall
*Attorney, Agent, or Firm*—Holman & Stern

[57] ABSTRACT

A starting system for an internal combustion engine includes an automatic temperature dependent delay timer which includes an output transistor and a thyristor connected across the base-emitter of the transistor so that the transistor is turned off when the thyristor is conducting. Firing pulses for the thyristor are derived from a programmable unijunction transistor which has associated with it a timing capacitor and a thermistor such that the charging time constant of the capacitor decreases with increasing temperature. The length of time for which the transistor remains on after the circuit is energized decreases with increasing temperature.

6 Claims, 2 Drawing Figures

STARTING SYSTEMS FOR INTERNAL COMBUSTION ENGINE

This invention relates to starting systems for internal combustion engines and particularly internal combustion engines of the diesel type, which require a special sequence of operations to be carried out when an attempt is to be made to start the engine in very low temperature conditions.

One problem which arises in such systems is the automatic timing of a temperature dependent delay period when engine starting is demanded and it is one object of the present invention to provide an automatic temperature dependent delay timer in a convenient form.

An internal combustion engine starting system in accordance with the invention includes an automatic temperature dependent delay timer including an output transistor which is biased to conduct, thyristor connected so as when conductive to turn the output transistor off, a timing capacitor, a charging circuit for the timing capacitor including a temperature sensing element such that the charging time constant of the capacitor decreases as the temperature sensed by said element increases and a unijunction transistor arranged to discharge the capacitor into the thyristor gate when the voltage on the capacitor exceeds a predetermined value.

The arrangement defined above may be used simply to light a warning lamp for the temperature dependent delay interval, so that the driver can continue the starting procedure. Alternatively the arrangement may be employed to operate a relay at the end of the temperature dependent delay interval, so as automatically to bring the starter motor into operation.

Figure 1:
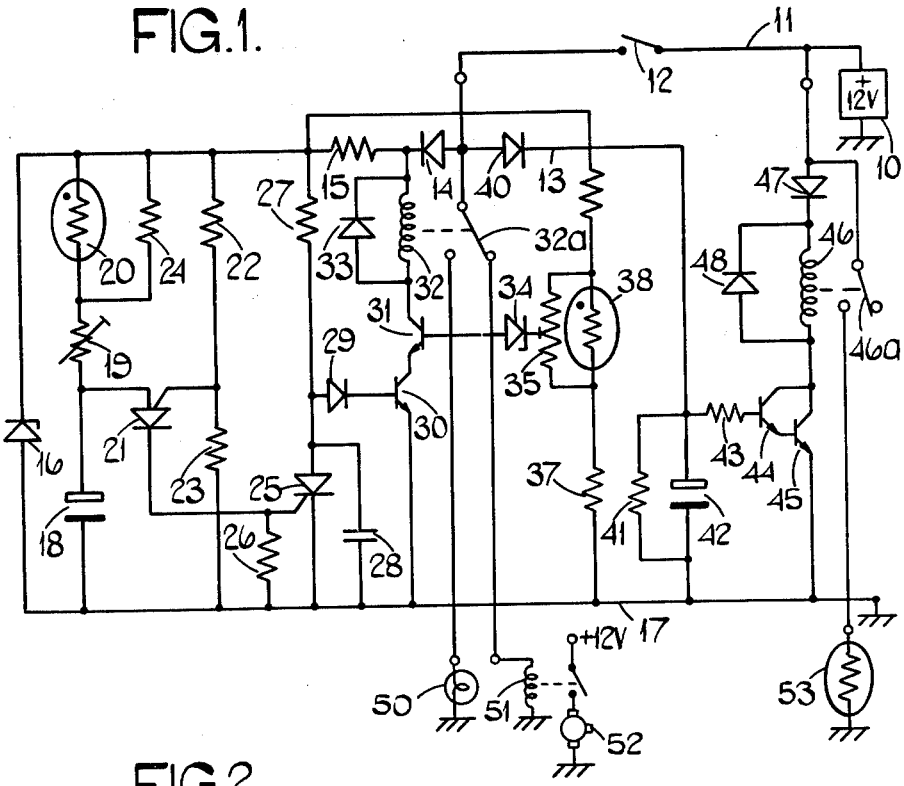
Figure 2:
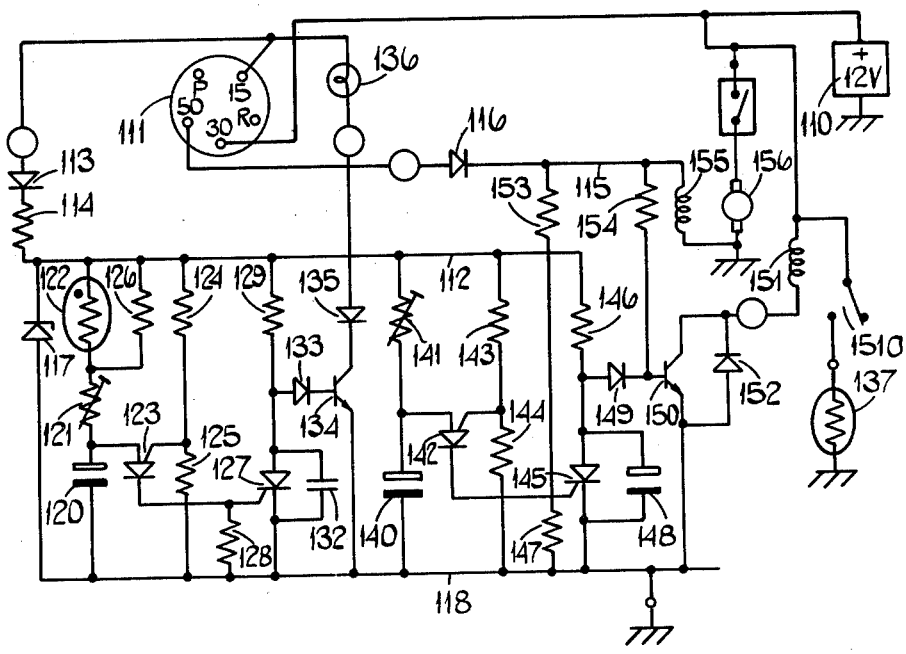

In the accompanying drawings FIGS. 1 and 2 are the circuit diagrams of two embodiments of the invention, which are described hereinafter by way of example.

Referring firstly to FIG. 1, the circuit shown is driven from a 12*v* vehicle battery 10 connected between a rail 11 and the vehicle earth. A starter switch 12 connects the rail 11 to a rail 13. The rail 13 is connected via a diode 14 and a resistor 15 to the cathode of a zener diode 16 the anode of which is connected to an earth rail 17. A timing capacitor 18 has one terminal connected to the rail 17 and its other terminal connected via a variable resistor 19 and a negative temperature coefficient thermistor 20 to the cathode of the zener diode 16. This other terminal of the capacitor 18 is also connected to the anode of a programmable unijunction transistor (PUT) 21. The gate terminal of the PUT 21 is connected, to the common point of two resistors 22, 23 connected in series between the cathode of the zener diode 16 and the rail 17. A resistor 24 is connected in parallel with the thermistor 20.

The cathode terminal of the PUT 21 is connected to the gate of a thyristor 25, the cathode of which is connected to the rail 17, a resistor 26 being connected between the gate and the rail 17. The anode of the thyristor 25 is connected by a resistor 27 to the cathode of the zener diode 16 and by a capacitor 28 to the rail 17. The anode of the thyristor 25 is also connected to the anode of a diode 29 the cathode of which is connected to the base of an npn output transistor 30. The emitter of the transistor 30 is connected to the rail 17 and its collector is connected to the emitter of an npn transistor 31, the collector of which is connected via a relay winding 32 to the cathode of the diode 14. A diode 33 is connected across the winding 32 to provide a conventional recirculating current path.

The base of the transistor 31 is connected to the anode of a zener diode 34, the cathode of which is connected to the slider of a potentiometer 35. One end of the potentiometer 35 is connected to the cathode of zener diode 16 by a resistor 36 and its other end is connected to the rail 17 by a resistor 37. A thermistor 38 is connected across the potentiometer 35.

A further diode 40 has its anode connected to the rail 13 and its cathode connected to the rail 17 by a resistor 41 and a capacitor 42 in parallel. The cathode of the diode 40 is also connected by a resistor 43 to the base of an npn transistor 44 connected with an npn transistor 45 as a Darlington pair, i.e. with the collectors of the transistors 44, 45 interconnected and with the emitter of the transistor 44 connected to the base of the transistor 45. The emitter of the transistor 45 is connected to the rail 17 and the collectors of the two transistors 44, 45 are connected via a relay winding 46 to the cathode of a diode 47 which has its anode connected to the rail 11. A diode 48 is connected across the winding 46.

The relay 32 has a change-over contact **32*a* with its common terminal connected to the rail 13, its normally open terminal connected to a warning lamp 50 and its normally closed terminal connected to a solenoid 51 associated with the starter motor 52. The relay 46 has a normally open contact 46*a* connected in series with a glow plug 53 between the rail 11 and the vehicle earth. The thermistor 20 is sensitive to ambient temperature and the thermistor 38** is sensitive to engine temperature.

When the switch 12 is closed the transistor 30 is turned on, since the resistor 26 and capacitor 28 prevent the thyristor 25 from turning on. Provided that the engine is cold, transistor 31 will also be on so that relay 32 is energised. Thus the solenoid 51 is disconnected and warning lamp 50 is lit. Capacitor 18 charges at a rate dependent on the ambient temperature until its voltage reaches a level adequate to turn on the PUT 21 and fire the thyristor 25. This turns off the transistor 30, thereby causing the solenoid 51 to be energised and the starter motor to be put into action. When the engine is hot transistor 31 is off and prevents the relay 32 from being energised so that the starter motor is put into action immediately.

When the switch 12 is closed capacitor 42 is rapidly charged up via diode 40 so that the transistors 44, 45 are turned on thereby energising the glow plug 53 via the relay 46. When the engine has been started the glow plug remains energised until the capacitor 42 has discharged via resistor 41 (these components having a time constant of approximately 5 seconds). The glow plug is energised every time the engine is started irrespective of whether the engine is hot or cold.

Turning now to the example of the invention shown in FIG. 2, the timing circuit is used only to operate a warning lamp to indicate when the driver can commence the starting operation.

The battery 110 is connected to a multi-position starter switch 111 feeding a supply rail 112 via a diode 113 and a resistor 114 in a first on position of the switch and a supply rail 115 via a diode 116 in a second on position of the switch. A zener diode 117 is connected between the rail 112 and an earth rail 118. The timing circuit consists of a capacitor 120, a variable resistor 121, a thermistor 122, a PUT 123, resistors 124, 125 and 126, a thyristor 127, resistors 128 and 129, a capacitor 132, a diode 133 and an output transistor 134 corresponding to the components 18 to 30 in FIG. 1. The collector of the transistor 134, however, is connected via a diode 135 and a warning lamp 136 to the anode of diode 113. When the switch 111 is turned to its first on position, therefore, the lamp 136 is lit for a variable time dependent on the ambient temperature.

There is also a second timing circuit for determining the length of time for which the glow plug 137 is energised, but this timing circuit provides a fixed length interval. This second timing circuit comprises a capacitor 140 connected in series with a variable resistor 141 between the rails 112 and 118, a PUT 142 with its anode connected to the junction of the resistor 141 and the capacitor 140, its gate connected to the junction of two resistors 143, 144 in series between the rails 112, 118 and its cathode connection to the gate of a thyristor 145. The cathode of the thyristor 145 is connected to the rail 118 and its anode is connected by a resistor 146 to the rail 112. A resistor 147 and a capacitor 148 connect the gate and anode respectively to the rail 118. A diode 149 connects the anode of the thyristor to the base of a npn output transistor 150 which has its emitter connected to rail 118 and its collector connected to the battery positive terminal via a relay winding 151. A diode 152 is connected across the collector-emitter of the transistor 150. The relay 151 operates a normally open contact 151*a* in series with the glow plug 137 between the battery +ve terminal and the vehicle earth.

A resistor 153 is connected between the rail 115 and the gate of the thyristor 145 and another resistor 154 connects the rail 115 to the base of the transistor 150.

For a cold start, the driver selects the first on position of the switch 111 and waits until the lamp 136 goes out before moving the switch to the second on position thereby energising the starter solenoid 155. When lamp 136 goes out, the second timing period would not normally have expired as this is a safety timer designed to have a longer time period than the temperature sensing timer. Timer 2 disconnects the glow plugs if no attempt to start is made within a certain period. If the second timer interval has not expired the thyristor 145 is fired via resistor 153 (to ensure that the capacitor 148 is discharged) and the transistor 150 is held on via the resistor 154. Thus, on returning from second position, relay 151 remains de-energised as thyristor 145 is triggered.

For a hot start the driver can turn the switch 111 directly to the second on position so that the timer circuits do not come into action.

What is claimed is:

1. An internal combustion engine starter motor control system including an automatic temperature dependent delay timer including an output transistor which is biased to conduct, a thyristor connected so as when conductive to turn the output transistor off, a timing capacitor, a charging circuit for the timing capacitor including a temperature sensing element such that the charging time constant of the capacitor decreases as the temperature sensed by said element increases and a unijunction transistor arranged to discharge the capacitor into the thyristor gate when the voltage on the capacitor exceeds a predetermind value.

2. An internal combustion engine starter motor control system as claimed in claim 1 including a warning lamp connected in series with said output transistor.

3. An internal combustion engine starter motor control system as claimed in claim 2 in which there is provided a second timer circuit arranged to have a time period longer than that of the first mentioned timer circuit and connected, for the duration of its time period to cause energisation of a glow plug starting aid device.

4. An internal combustion engine starter motor control system as claimed in claim 1 including a relay having its winding in series with said output transistor, said relay operating when de-energised to energise a starter circuit.

5. An internal combustion engine starter motor control system as claimed in claim 4 including temperature sensitive switch means for overridingly maintaining the relay de-energised when the temperature is above a predetermined level.

6. An internal combustion engine starter motor control system as claimed in claim 5 in which said temperature sensitive switch means comprises a further transistor in series with the output transistor and the relay winding, the base of said further transistor being connected to a point on a voltage dividing network including a temperature sensitive element.

* * * * *